US007073980B2

(12) United States Patent
Merjan et al.

(10) Patent No.: US 7,073,980 B2
(45) **Date of Patent: *Jul. 11, 2006**

(54) PILING

(76) Inventors: Stanley Merjan, 96 Barkers Point Rd., Sands Point, NY (US) 11050; John Dougherty, 851 Meadow La., Franklin Lakes, NJ (US) 07417

( * ) Notice: Subject to any disclaimer, the term of this patent is extended or adjusted under 35 U.S.C. 154(b) by 52 days.

This patent is subject to a terminal disclaimer.

(21) Appl. No.: 10/730,385

(22) Filed: Dec. 8, 2003

(65) Prior Publication Data

US 2004/0115008 A1 Jun. 17, 2004

Related U.S. Application Data

(63) Continuation-in-part of application No. 10/241,962, filed on Sep. 12, 2002, now abandoned, which is a continuation-in-part of application No. 09/947,854, filed on Sep. 7, 2001, now Pat. No. 6,468,003, and a continuation-in-part of application No. 09/275,991, filed on Mar. 25, 1999, now Pat. No. 6,309,143.

(60) Provisional application No. 60/116,643, filed on Jan. 21, 1999, provisional application No. 60/086,916, filed on May 27, 1998.

(51) Int. Cl.
*E02D 7/14* (2006.01)

(52) U.S. Cl. ..... 405/253; 405/231; 405/232; 405/251; 52/169.9; 52/721.4; 52/726.4

(58) Field of Classification Search ..... 405/229, 405/231–233, 250–256; 52/169.9, 721.4, 52/726.4; 175/19, 435
See application file for complete search history.

(56) References Cited

U.S. PATENT DOCUMENTS 975,488 A 11/1910 Welsh
1,074,275 A 9/1913 Mac Lean
1,447,407 A * 3/1923 Blumenthal ..... 405/243
1,454,434 A * 5/1923 Gardner ..... 405/243
1,954,070 A 4/1934 Cook
2,065,507 A 12/1936 Alexander
2,151,847 A 3/1939 Greulich
2,168,269 A 8/1939 Orr
2,198,989 A 4/1940 Bailey
2,308,793 A * 1/1943 Upton ..... 405/216
2,326,872 A 8/1943 Marsden
2,430,879 A 11/1947 Kohn
2,465,557 A * 3/1949 Thornley ..... 405/233
2,924,949 A 2/1960 Smith
2,926,500 A 3/1960 Hoppe
2,983,104 A 5/1961 Bruns
3,034,209 A 5/1962 Bianca
3,199,300 A 8/1965 Fiore
3,217,459 A 11/1965 Meyer
3,316,724 A * 5/1967 Tsuzuki ..... 405/251

(Continued)

FOREIGN PATENT DOCUMENTS

EP 027202075 12/1987

(Continued)

OTHER PUBLICATIONS

Pages 158 and 159 of "Foundation Construction" by A. Brinton Corson. Published 1956 by McGraw-Hill Co.

(Continued)

*Primary Examiner*—Jong-Suk (James) Lee

(57) ABSTRACT

A pile comprising a tapered steel tube of convex polygonal cross-section driven into the ground and then filled with concrete provides high load carrying capacity even in cohesive soils.

7 Claims, 5 Drawing Sheets

U.S. PATENT DOCUMENTS

| | | | |
|---|---|---|---|
| 3,421,781 | A | 1/1969 | Spurk |
| 3,422,630 | A | 1/1969 | Marier |
| 3,522,707 | A | 8/1970 | Fuentes |
| 3,664,139 | A | 5/1972 | Sexauer |
| 3,668,871 | A | 6/1972 | Fuentes |
| 3,779,025 | A | 12/1973 | Godley |
| 3,865,498 | A | 2/1975 | Okuta |
| 3,899,891 | A | 8/1975 | Kelly |
| 4,009,550 | A | 3/1977 | Young |
| 4,018,055 | A | 4/1977 | Le Clercq |
| 4,127,002 | A | 11/1978 | De Witt |
| 4,239,419 | A | 12/1980 | Gillen |
| 4,322,181 | A | 3/1982 | Streich |
| 4,604,003 | A | 8/1986 | Francoeur et al. |
| 4,621,950 | A | 11/1986 | Kinnan |
| 4,697,959 | A | 10/1987 | Kinnan |
| 4,915,544 | A | 4/1990 | Lin |
| 5,032,041 | A | 7/1991 | Sinnes |
| 5,438,812 | A | 8/1995 | Erickson |
| 5,462,317 | A | 10/1995 | Keller |
| 5,975,808 | A | 11/1999 | Fujita |
| 6,309,143 | B1 | 10/2001 | Merjan |
| 6,468,003 | B1 | 10/2002 | Merjan et al. |
| 2002/0056250 | A1* | 5/2002 | Cash ..... 52/726.4 |

FOREIGN PATENT DOCUMENTS

| | | | |
|---|---|---|---|
| GB | 2093939 | A | 2/1982 |
| GB | 2172038 | A | 2/1985 |

OTHER PUBLICATIONS

Three photographs of transmission towers in-public use.

"Experimental Investigations of Bearing Capacity of Bored-Cast-in-Place Piles" by Rybnikov,A.M. from Soil Mechanics and Foundation Engineering, vol. 27, Issue 2, 1990, pp. 48-52.

"Construction of Compaction Tapered Pile Foundations" by Zil'berberg, S.D., and Shertsnev, A.D. from Soil Mechanics and Foundation Engineering, vol. 27, Issue, 3, 1990, pp. 96-101.

"Axial Response of Tapered Piles in Cohesive Frictional Ground" by Kodikara, Journal of Geotech. Engineering, vol. 119, No. 4, Apr. 1993.

* cited by examiner

PILING

CROSS-REFERENCES AND RELATED APPLICATIONS

This application is a continuation-in-part of our application Ser. No. 10/241,962 filed Sep. 12, 2002 now, abandoned, which is a continuation in part of our patents Ser. No. 09/275,991, filed Mar. 25, 1999, now U.S. Pat No. 6,309,143 B1 of Oct. 30, 2001 (hereafter "143") and Ser. No. 09/947,854, filed Sep. 7, 2001, now U.S. Pat. No. 6,468,003 of Oct. 22, 2002 (hereafter "003") and also claims priority of the following provisional applications of ours: 60/086,916 filed May 27, 1998 and 60/116,643 filed Jan. 21, 1999.

FIELD OF THE INVENTION AND DETAILED DESCRIPTION OF THE INVENTION

This invention relates to piling

The entire disclosure of said patents '143 and '003 is hereby incorporated herein by reference.

Also incorporated herein by reference is the entire disclosure of said application Ser. No. 10/241,962 which was published as Publication 20, US-2003-0014929-A1 on Jan. 23, 2003.

DESCRIPTION OF THE USE OF THE PILES IN COHESIVE SOIL

Figure 1:
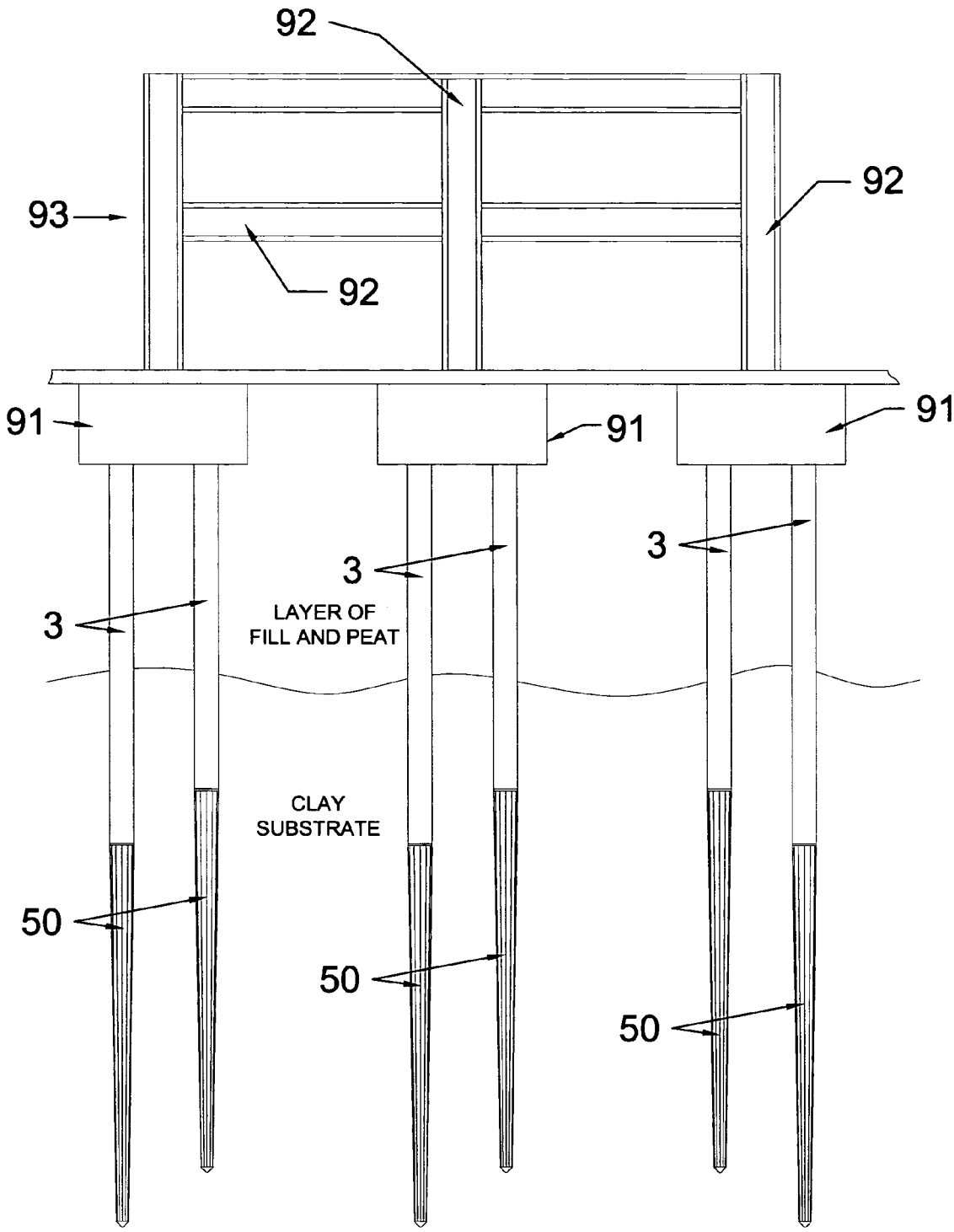
FIG. 1 is a schematic side view of the framework of a building supported by piles whose tapered sections are embedded in cohesive soil.

It has been found that the piles of this invention can provide a surprisingly high load-carrying capacity even if the pile driving is stopped when the tapered body is largely embedded in cohesive soil (such as clay or cohesive silt) rather than in granular soil. At that stage the energy needed for further driving (as measured by resistance of the pile to movement under the blows of the pile-driving hammer) is relatively small but the actual load-carrying capacity, as measured by load tests, can be much higher than that expected for such a small driving energy. This discovery makes it unnecessary, for instance and in many cases, to continue driving through the cohesive soil down into an underlying layer of granular soil. Examples 1, 2 and 3 below illustrate the driving into cohesive soil. It will be understood that, after the driving described in each of these Examples, a supported structure (such as a conventional pile cap and a building supported thereon, or the base slab of a fuel tank) is placed on the pile while the tapered body is still largely embedded in the cohesive soil layer.

EXAMPLE 1

A pile consisting of a 25 foot long steel tapered bottom section having a bottom diameter of 8 inches and a top diameter of 18 inches, and welded to a 40 foot long cylindrical pipe having an 18 inch diameter, driven through 25 feet of fill and organic peat and penetrating into 35 feet of clay (stable) having an 'N' value of 10 can develop 120 tons or more of allowable capacity at a driving resistance of 12 blows per linear foot of penetration under the blows of a hammer delivering 30,000 foot-pounds of energy.

EXAMPLE 2

A pile as in example 1 except that the pipe is 110 feet long driven through 70 feet of fill and organic clay (which, because of its organic content, will deteriorate with time and is therefore unstable for pile-support), then 10 feet of sand having and 'N' value of 12 and then 40 feet into a layer of clayey silt (stable) having an average 'N' value of 8 can develop 140 tons or more of allowable capacity at a driving resistance of 22 blows per foot of penetration under the blows of a hammer delivering 45,000 foot-pounds of energy.

EXAMPLE 3

A pile having a 15 foot long steel tapered bottom with an 8 inch bottom diameter, 14 inch top diameter, welded to a 14 inch diameter cylindrical steel pipe 55 feet long driven through 20 feet of fill, than 15 feet of organic soils, and then into 30 feet of silt and silty sand having an average 'N' value of 15 can develop and allowable capacity of 80 tons at a driving resistance of 24 blows per foot under the blows of a hammer delivering 22,000 foot-pounds of energy.

In FIG. 1 piles of this invention have their tapered bottom portions 50 entirely embedded in clay soil. The piles, which have upper pipe portions 3, are arranged in groups or clusters under the conventional pile caps 91 which are placed on the piles after the latter have been driven. The pile caps in turn are used to support the columns 92 of a building 93. The depth of the clay substrate is much greater than the depth to which the piles have penetrated into that substrate. Especially good results can be obtained when the clay substrate is of the kind known as over-consolidated clay.

DESCRIPTION OF PILES COMPOSED OF A PLURALITY OF TAPERED SECTIONS

As described in '143, the tapered polygonal sections can be produced by folding a single sheet of steel. '143 states that the "tapered lengths" may be fabricated in lengths of 5 to 40 feet (1.5 m to 12 m)'. With present equipment the production of the tapered structures in lengths greater than about 40 feet by folding a single sheet is relatively impractical. However, for some soil conditions and support criteria it is desirable to use still longer tapered structures, e.g. of lengths as great as about 80 feet (24 m) or longer (as noted in '143 with reference to its FIG. 11). Such tapered piles, illustrated in FIGS. 2 to 5, nay be composed of two (or more) separately folded tapered tubes. For example, the pile may be composed of a lower tapered polygonal portion 101, 30 feet long, having a bottom diameter of 8 inches to which is butt welded, at 102, an upper polygonal portion 103, 30 feet long, the diameter and cross section of the bottom 104 of that upper portion 103 being the same as the cross section of the top of portion 101 and the top 106 of the upper portion 103 having a diameter of 32 inches, so that the slope of the entire pile is 0.0167 foot per linear foot. A tip 107 is welded to the bottom of the lower portion 101. In the piles shown in FIGS. 2 to 4 the top 106 is of polygonal cross section and driven by direct blows of a pile driving hammer having a recess 111. The recess shown is circular in cross section and has a diameter corresponding to that of top 106.

Figure 2:
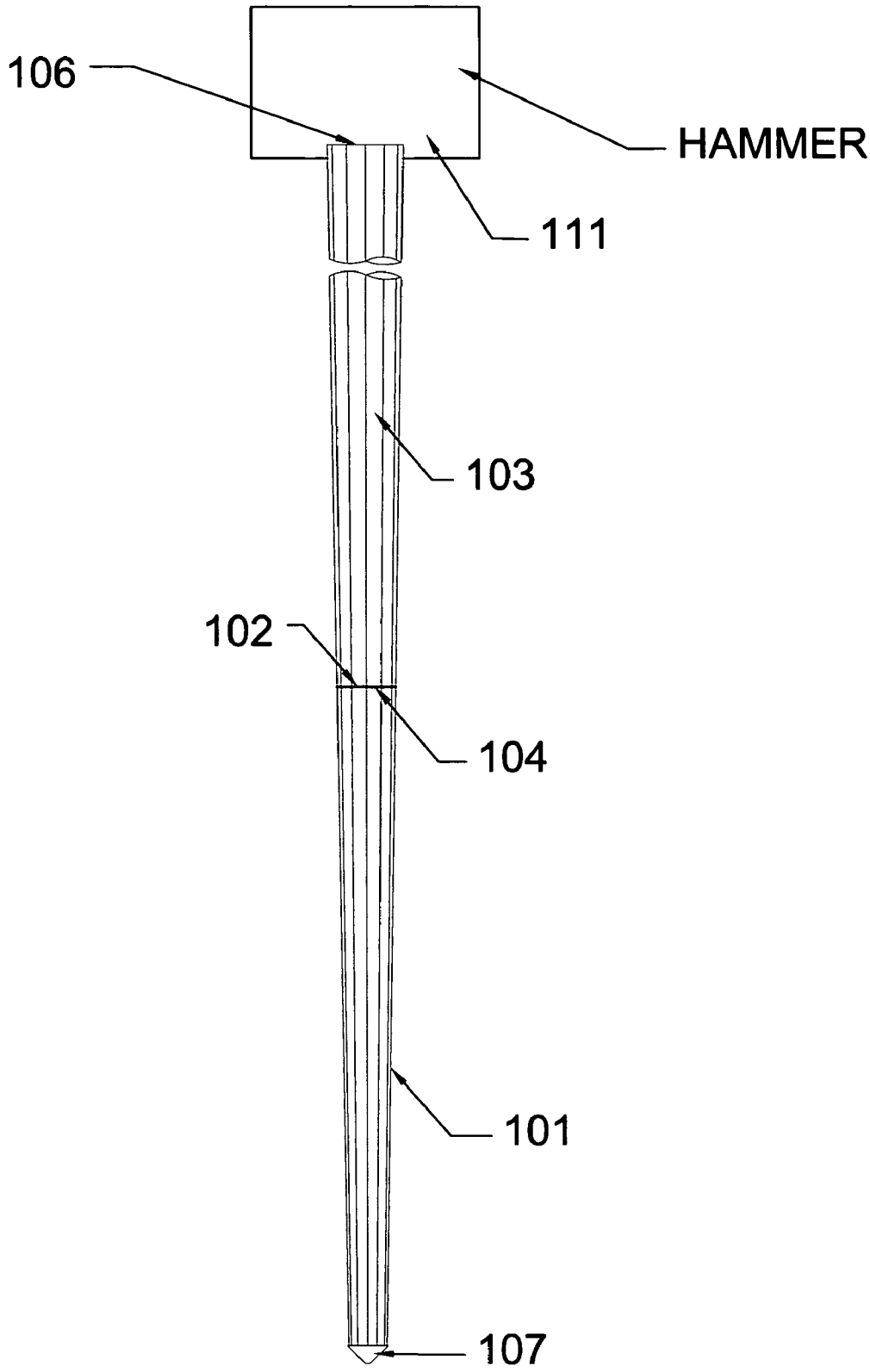
FIG. 2 is a view in elevation of a pile composed of a plurality (two in this case) of tapered portions butt welded together (as disclosed in '143 with respect to its FIG. 11). It also shows the hammer used to drive that pile.
Figure 3:
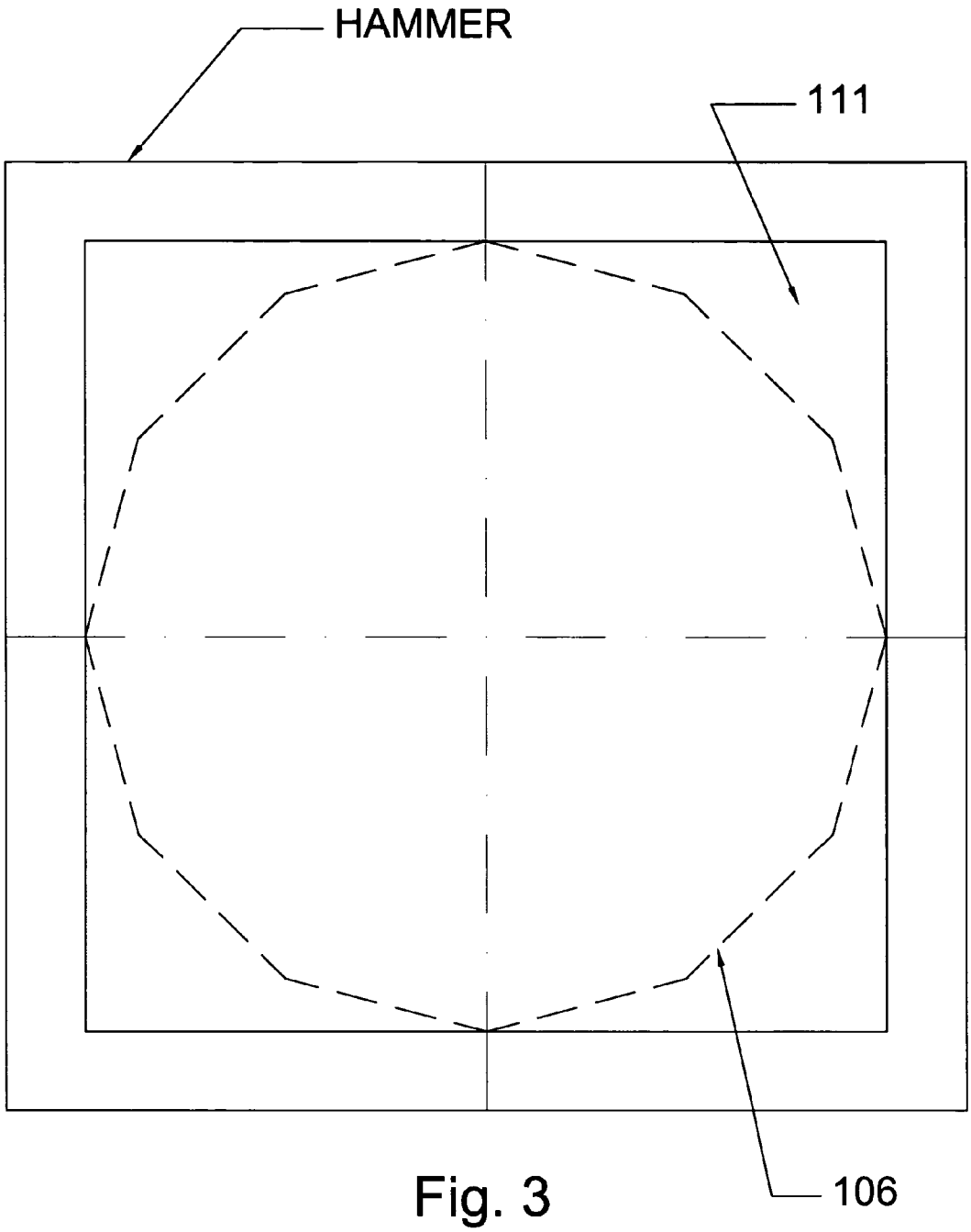
FIG. 3 is a plan view of the bottom of the pile driving hammer of FIG. 2, showing, in dashed lines, the outline of the top of the pile of FIG. 2.
Figure 4:
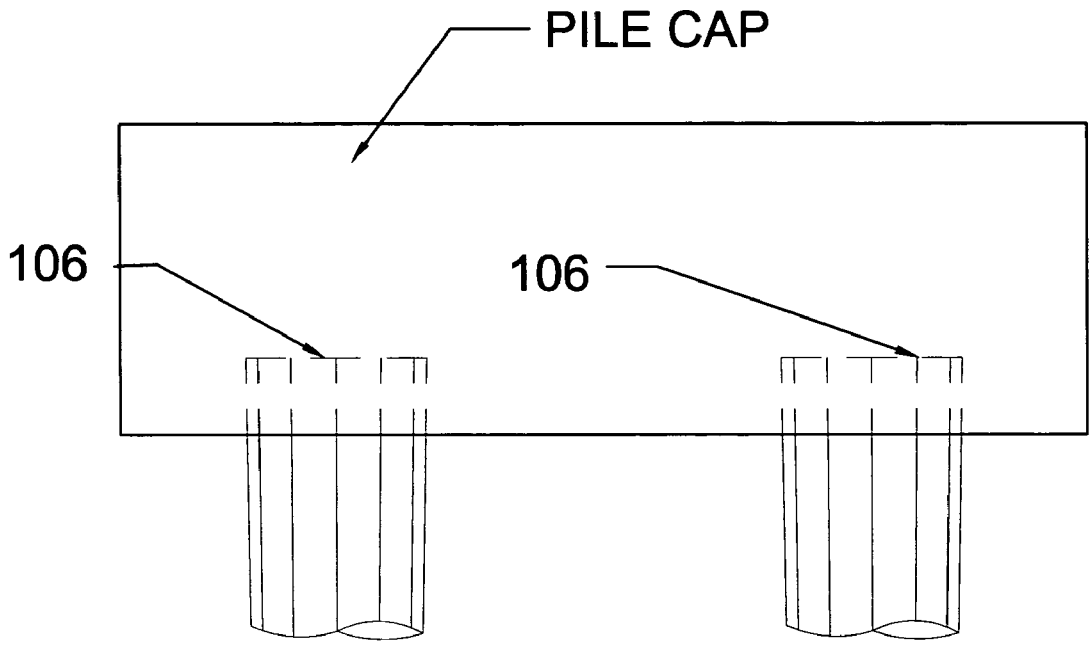
FIG. 4 is a view in elevation of groups of the piles of FIG. 2 driven into the ground and overlain by a pile cap.
Figure 5:
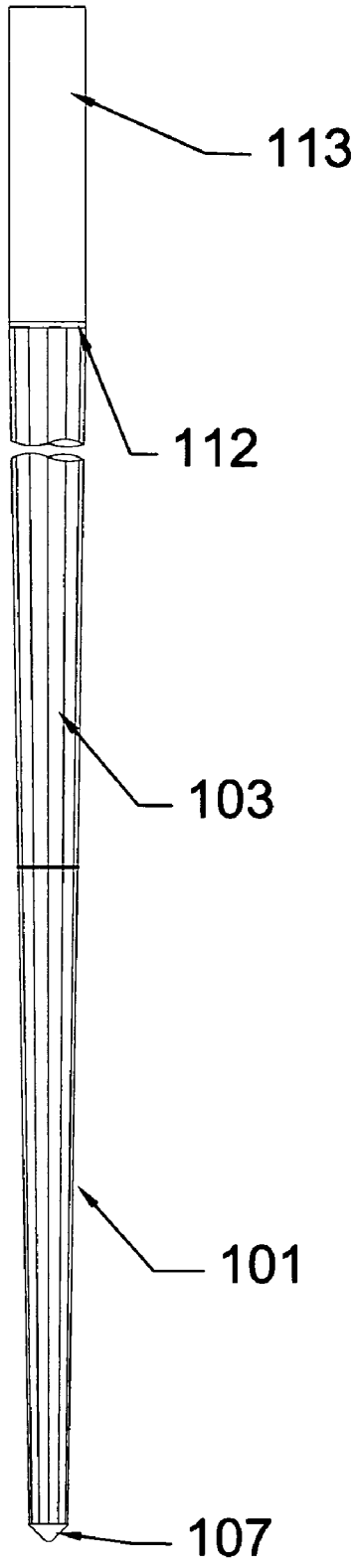
FIG. 5 is a view in elevation of the top of a structure like that of FIG. 2 except that the top has been formed to a circular cross section for attachment to a circular pipe.

As shown in FIG. 5 the top 112 of the upper portion of piles like those of FIGS. 2 to 4 may be formed to circular cross section and butt welded to a circular pipe 113 in the manner described in '143. The pile is preferably driven into the ground by blows applied to the top of pipe 113.

It is understood that the foregoing detailed description is given merely by way of illustration and that variations may be made without departing from the spirit of the invention. The Abstract is given merely for the convenience of technical researchers and is not to be given any weight with respect to the scope of the invention.

We claim:

1. A pile comprising a hollow uniformly tapered steel body, said tapered body having a cross-section, taken perpendicular to a longitudinal axis, which is a convex polygon having 8 to 24 sides, said sides being substantially equal in length, said body being at least about 3 meters long, having a lower diameter which is about 200 mm to 400 mm and a larger upper diameter and being of steel about 5 to 13 mm thick formed from sheet steel folded into the tapered shape of said convex polygon and having its longitudinally extending free edges welded together, said body having at its bottom a closure constructed and arranged to substantially prevent ingress of the soil into said body during the driving of the pile, the construction and arrangement of said hollow body being such that said hollow body can be driven into the ground by hammer blows transmitted to the hollow unfilled top of said body and be filled with concrete thereafter.

2. A pile as in claim 1, said polygon being a substantially regular polygon.

3. A driven pile in place in the ground, said pile having at its lower end the body of claim 1 filled with concrete.

4. A pile comprising a hollow uniformly tapered steel body, said tapered body having a cross-section, taken perpendicular to a longitudinal axis, which is a convex polygon having 8 to 24 sides, said sides being substantially equal in length, said body being at least about 3 meters long, having a lower diameter which is about 200 mm to 400 mm and a larger upper diameter and being of steel about 5 to 13 mm thick formed from sheet steel folded into the tapered shape of said convex polygon and having its longitudinally extending free edges welded together, said body having at its bottom a closure constructed and arranged to substantially prevent ingress of the soil into said body during the driving of the pile, the very top of said body being formed to a circular cross-section such that said top can engage with, match and be butt-welded to the end of a straight pipe of corresponding circular cross-section, the construction and arrangement of said hollow body being such that said hollow body can be driven into the ground by hammer blows transmitted to the hollow unfilled top of said body and be filled with concrete thereafter.

5. A pile as in claim 4, said polygon being a substantially regular polygon.

6. A pile driving process which comprises driving a hollow uniformly tapered steel body into the ground by blows transmitted to the very top of said body and filling said body with concrete, said tapered body having a cross-section, taken perpendicular to a longitudinal axis, which is a convex polygon having 8 to 24 sides, said sides being substantially equal in length, said body being at least about 3 meters long, having a lower diameter which is about 200 mm to 400 mm and a larger upper diameter and being of steel about 5 to 13 mm thick formed from sheet steel folded into the tapered shape of said convex polygon and having its longitudinally extending free edges welded together, said body having at its bottom a closure constructed and arranged to substantially prevent ingress of the soil into said body during the driving of the pile.

7. A process as in claim 6, said polygon being a substantially regular polygon.

* * * * *